US009162094B2

(12) United States Patent
Hsieh

(10) Patent No.: US 9,162,094 B2
(45) Date of Patent: Oct. 20, 2015

(54) DOOR MACHINE MECHANISM FOR ROLLING DOOR HAVING FUNCTIONS OF FIREPROOF, SMOKEPROOF, AND FIRE ESCAPE

(71) Applicant: Chung-Hsien Hsieh, New Taipei (TW)

(72) Inventor: Chung-Hsien Hsieh, New Taipei (TW)

( * ) Notice: Subject to any disclaimer, the term of this patent is extended or adjusted under 35 U.S.C. 154(b) by 0 days.

(21) Appl. No.: 14/014,546

(22) Filed: Aug. 30, 2013

(65) Prior Publication Data

US 2014/0060754 A1 Mar. 6, 2014

(30) Foreign Application Priority Data

Aug. 31, 2012 (TW) ..... 101131746 A

(51) Int. Cl.

| | |
|---|---|
| ***E06B 5/00*** | (2006.01) |
| ***A62C 2/06*** | (2006.01) |
| ***A62C 2/24*** | (2006.01) |
| ***E06B 9/70*** | (2006.01) |

(52) U.S. Cl.
CPC . *A62C 3/14* (2013.01); *A62C 2/247* (2013.01); *E06B 5/00* (2013.01); *E06B 9/70* (2013.01)

(58) Field of Classification Search
CPC ..... E06B 9/70; E06B 5/00; A62C 3/14; A62C 2/247
USPC ..... 160/1, 2, 3, 6, 7, 9, 188, 310
See application file for complete search history.

(56) References Cited

U.S. PATENT DOCUMENTS

| | | | | |
|---|---|---|---|---|
| 5,203,392 | A * | 4/1993 | Shea | 160/7 |
| 5,278,480 | A * | 1/1994 | Murray | 318/626 |
| 5,386,891 | A | 2/1995 | Shea | |
| 5,557,887 | A * | 9/1996 | Fellows et al. | 49/28 |
| 5,673,514 | A * | 10/1997 | McKeon | 49/30 |
| 5,893,234 | A * | 4/1999 | McKeon | 49/30 |
| 6,003,920 | A * | 12/1999 | Crisp | 296/37.1 |
| 7,275,631 | B2 * | 10/2007 | Hsieh | 192/226 |
| 8,069,896 | B2 * | 12/2011 | Magro | 160/1 |
| 8,397,787 | B1 * | 3/2013 | Daus et al. | 160/9 |
| 8,484,897 | B2 * | 7/2013 | Hsieh | 49/199 |
| 8,651,164 | B2 * | 2/2014 | Klish et al. | 160/7 |
| 2006/0124250 | A1 * | 6/2006 | Hsieh | 160/9 |
| 2010/0242364 | A1 * | 9/2010 | Magro | 49/31 |
| 2012/0024484 | A1 * | 2/2012 | Hsieh | 160/291 |
| 2014/0318719 | A1 * | 10/2014 | Hsieh | 160/133 |

* cited by examiner

*Primary Examiner* — Katherine Mitchell
*Assistant Examiner* — Scott Denion
(74) *Attorney, Agent, or Firm* — Bui Garcia-Zamor; Jessica H. Bui, Esq.

(57) ABSTRACT

A door machine mechanism for a rolling door has an electric machine mechanism, a brake mechanism and an output mechanism. In normal power supply condition, the rolling door is opened by the electric machine mechanism. In case of fire, the brake mechanism releases brake so that the rolling door moves downward by its own weight. However, in an emergency condition, if an external force is applied to push the door upward, the rolling door will be reopened by an assistance of spare electricity to the electric machine mechanism.

17 Claims, 6 Drawing Sheets

DOOR MACHINE MECHANISM FOR ROLLING DOOR HAVING FUNCTIONS OF FIREPROOF, SMOKEPROOF, AND FIRE ESCAPE

BACKGROUND OF THE INVENTION

1. Field of the Invention

This invention relates to a door machine mechanism, more particularly to a door machine mechanism for a rolling door having fireproof, smokeproof, and escape functions by which the rolling door can be opened in a reverse direction by a one-way transmission device.

2. Brief Description of Prior Art

Generally, rolling door can be cataloged as fire doors, smokeproof doors, emergency doors and escape doors according to their usage, function and purpose. The conventional fire doors or the smokeproof doors are classified into two types based on their operational mode: one type is failsafe mode, and the other type is a non-failsafe mode. In the case of the failsafe mode, a brake is immediately released to let the rolling door move downward by its own weight and close, if electric power is interrupted, no matter what the cause of which is. However, if the electric power is not interrupted on a firing, the electric power will be cut out by, for example, smoke detector, temperature sensor or other fire detecting devices, or is cut out mechanically by fusible link devices, in which a fusible metal will be melted by fire. Hence the brake is released to close the rolling door by the way as stated above. On the other hand, for the non-failsafe mode, the rolling door is not closed immediately after an interruption of electric service. Only after an occurrence of firing is detected by, for example, smoke detector, temperature sensor or other fire detecting device, and a short duration of electric current from a spare power source, such as capacitor, battery or the like, is fed for releasing the brake for a short time period, or fusible link devices for mechanically releasing brake are melted due to high temperature of fire, the rolling door moves downwardly and closes by its own weight. The above-mentioned fire door and smokeproof door generally have equipped with a manual operation mechanism, such as a hand chain wheel with an endless chain, to drive a transmission mechanism of the rolling door. If the cause of the interruption of electric service is not due to firing and the rolling door is needed to be opened, or the cause is due to firing and the rolling door must be opened for fire escape, the rolling door can be lifted up by driving the hand wheel through an exertion on the endless chain. When the rolling door must be opened for emergent escape in case of firing, much time and physical effort have to be consumed for opening the rolling door by manual operation, which will render vital delay of escaping.

However, a design of emergency door or escape door is contrary to that of fire door in usage and function, i.e., the fire door should be maintained to be unimpeded or easily opened in a power interruption condition. Therefore, for manufacturing industries, a variety of door machine mechanisms have to be developed to cope with different demands based on location for installing a door machine mechanism, desired function and purpose. Not only time required for development for a machine mechanism is long, production cost is high, but also number of parts is high, and hence which may cause their production process becoming complicated and high inventory.

A lot of relevant patents concerning door machine mechanism of fire door have been proposed, such as U.S. Pat. No. 5,673,514, U.S. Pat. No. 5,893,234, U.S. Pat. No. 5,203,392, and U.S. Pat. No. 5,386,891. Basically, for the above patents, a rolling door slides downward to shut a door by its own weight of gravity under a power interruption condition so as to block thick smoke or raging flame from scattering. Further, in the above patents, the rolling door can be lifted up directly by hands without using a hand chain wheel and endless chain as described above. However, using physical force to resist against the weight of the rolling door to open the door will consume enormous physical effort, which especially is too difficult for feeble men.

SUMMARY OF THE INVENTION

The main object of the present invention is to provide a novel door machine mechanism for a rolling door having functions of fireproof, smokeproof and fire escape, so as to render a better practical usage, comparing to a specific type of conventional door machine.

Another object of the present invention is to provide a door machine mechanism for a rolling door having functions of fireproof, smokeproof and fire escape, which can cope with various demands only by a single model as far as different locations of installation, functions and purposes are to be concerned. Not only it has the merits of fewer components, simplified structure, short time for development, low production cost, simplified production process, but also inventory is low.

In order to achieve the aforementioned and the other objects, the door machine mechanism of rolling door according to the present invention comprises:

an electric machine mechanism having a rotary shaft for driving an winding shaft for door slats;

a brake mechanism having a braking disc fixedly connected with the rotary shaft, a braked disc being coaxial and connected with the braking disc in an axially movable manner; an electromagnetic disc being in stationary state and separated from the braked disc by a gap, the electromagnetic disc in excited state attracting the braked disc to connect with each other so as to hold the rotary shaft unmoved; an output mechanism having an output shaft, an output pulley and an one-way transmission device, the first end of the output shaft being axially coupled to the rotary shaft, the one-way transmission device including an active member fixed at the second end of the output shaft and a passive member connected with the output pulley, the passive member being limited to follow with the active member in a preset direction, the output pulley being connected with the winding shaft for door slats in such a manner that if the output shaft rotates in a preset rotation sense, it can rotate freely relative to the output pulley, and if the output shaft drives in a direction opposite to the preset rotation sense the output pulley is rotated by the rotation of the output shaft.

a control circuit electrically connected with one direction detector, one fire detection device and a battery module for spare electricity, the direction detector being used for detecting a rotation sense of the passive member.

In this way, under normal power supply condition, the control circuit controls the electric machine mechanism to drive the output shaft to rotate in a direction reverse to the rotation sense of the preset direction, so that the output pulley drives the winding shaft to wind up the door slats upward; and if the electric machine mechanism stops to rotate, the electromagnetic effect of the electromagnetic disc brakes the rotary shaft. However, in a power interruption state, if a fire is confirmed by the fire detection device, then the electromagnetic disc stops magnetic excitation and the brake disc is released so that the door slats move downward by their own weight to shut the rolling door; or, in an emergency condition, if an external force is applied to push the door slats upward and the direction detector detects the upward moving of the door slats, then a power is supplied from the battery module to the electric machine mechanism so as to make an assistance to opening of the rolling door, which falls down automatically again to close the rolling door after the rolling door reopening for a predetermined time.

BRIEF DESCRIPTION OF ACCOMPANYING DRAWINGS

FIG. 1 is a partially exploded perspective view showing the first embodiment of door machine mechanism of the present invention.

FIG. 1*a* is a perspective exploded view showing the door machine mechanism of FIG. 1.

FIG. 1*b* is a partially exploded side view showing the door machine mechanism of FIG. 1 in an assembly state.

FIG. 1*c* is a sectional schematic view taken along line 1*c*-1*c* of FIG. 1*b*.

FIG. 1*d* is a sectional view showing the action of the brake mechanism of the present invention, in which (a) is in a non-excited state (that is in a brake release state); (b) is in an excited state (that is in a braked state).

FIG. 1*e* is a sectional schematic view taken along line 1*e*-1*e* of FIG. 1*b*.

FIG. 1*f* is a sectional schematic view taken along line 1*f*-1*f* of FIG. 1*b*.

FIG. 1*g* is a schematic view showing the state of implementation of the door machine mechanism of FIG. 1 used in a rolling door.

FIG. 2 is a partially exploded perspective view showing the second embodiment of door machine mechanism of the present invention.

FIG. 2*a* is a partially enlarged view of encircled part in FIG. 2, which shows the brake mechanism in a brake state.

FIG. 2*b* is a partially enlarged view showing the clutch mechanism of FIG. 2.

FIG. 2*c* is a sectional schematic view taken along line 2*c*-2*c* of FIG. 2.

DETAILED DESCRIPTION OF PREFERRED EMBODIMENTS

The technical contents of the present invention will become more apparent from the detailed description of the preferred embodiments in conjunction with the accompanying drawings. It is noted that the preferred embodiments are purely illustrative, not intend to restrict the implementation range of the present invention.

Figures 1, 1A:
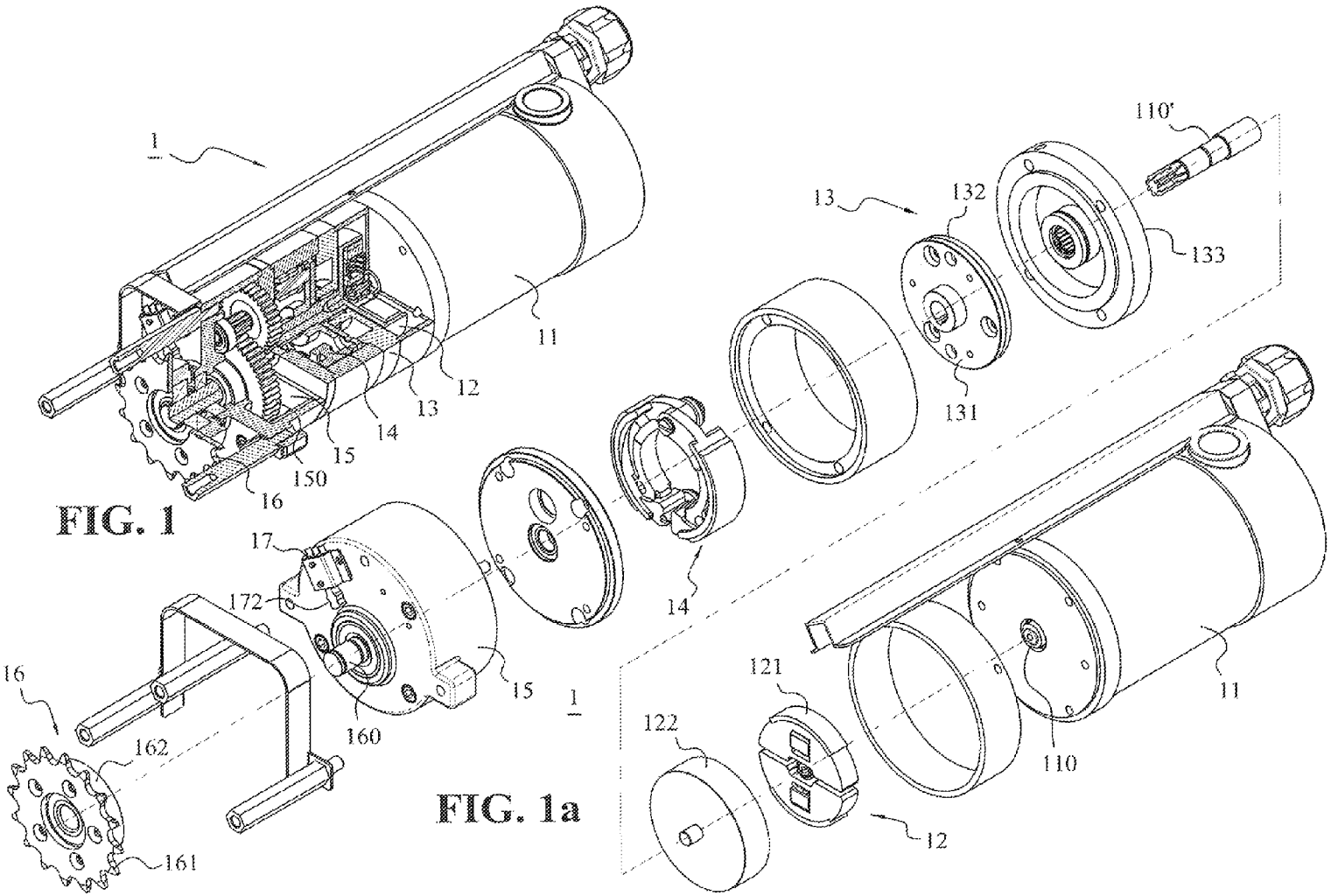
Figure 1B:
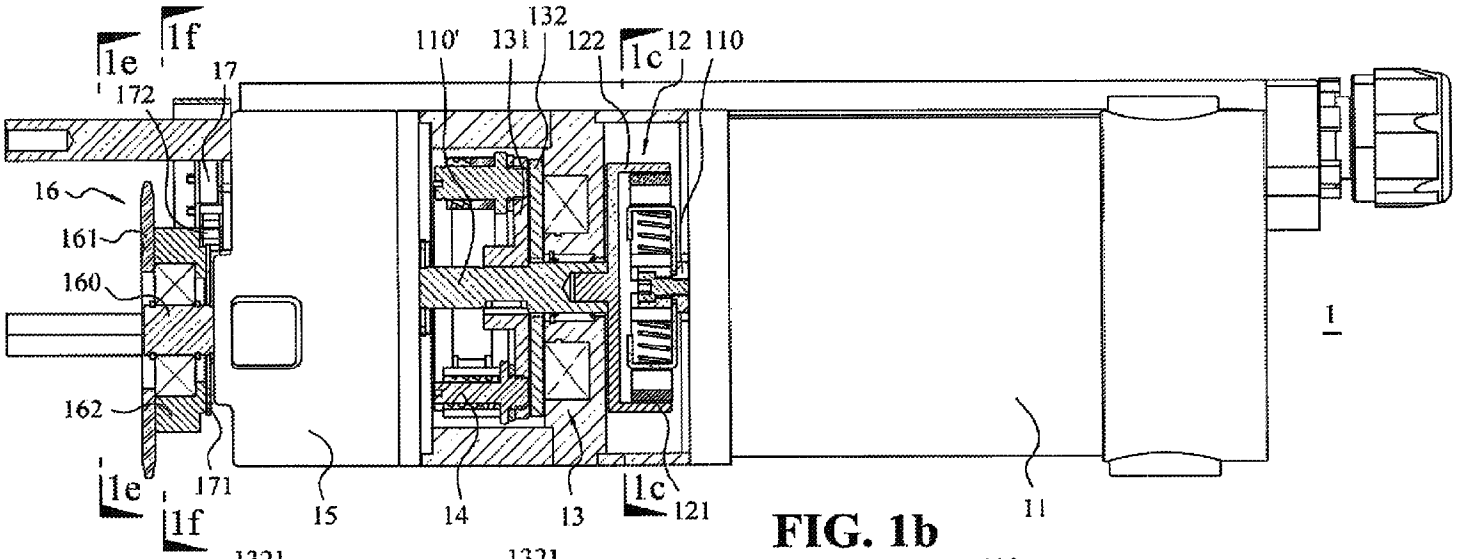

Firstly, referring to FIGS. 1, 1*a* and 1*b*, a door machine mechanism 1 of a rolling door of the present invention mainly comprises: an electric machine mechanism 11, a clutch mechanism 12, a brake mechanism 13, a centrifugal brake mechanism 14, a reduction mechanism 15, an output mechanism 16, and a system control circuit E connected with a fire detection device, such as smoke detector, temperature sensor, fusible links device. When a fire is confirmed by the fire detection device, the rolling door is activated to move downward automatically at the first instant of fire so as to block fire flame and smoke from scattering. As this control technology is conventional, its description is omitted herein.

As shown in the figures, the electric machine mechanism 1 has a rotary shaft 110. The electric machine mechanism 1 is preferably a DC motor and can still get spare power supply from a spare power source in a condition of public electricity supply interruption. An intermediate rotary shaft 110' is further provided; the relationship of this intermediate rotary shaft 110' with the rotary shaft 110 will be described later.

Figure 1C:
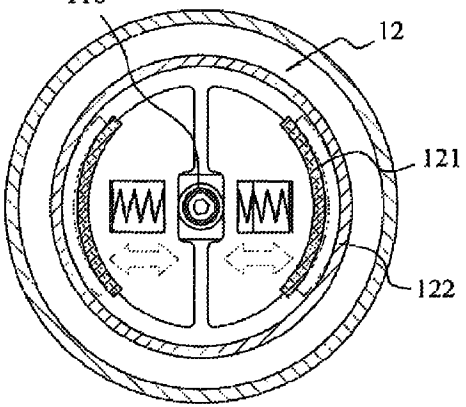

The clutch mechanism 12 comprises a first clutch member 121 and a second clutch member 122, in which the first clutch member 121 is connected with the rotary shaft 110 of the electric machine mechanism 1 and the second clutch member 122 is connected with the right side end of the intermediate rotary shaft 110'. After rotation, the first clutch member 121 is coupled with the second clutch member 122 by centrifugal action, as shown in FIG. 1*c*, so that the intermediate rotary shaft 110' is rotated with the rotation of the rotary shaft 110 of the electric machine mechanism 1, or the intermediate rotary shaft 110' is decoupled from the rotary shaft 110 when the electric machine mechanism 1 is deenergized.

Figure 1D:
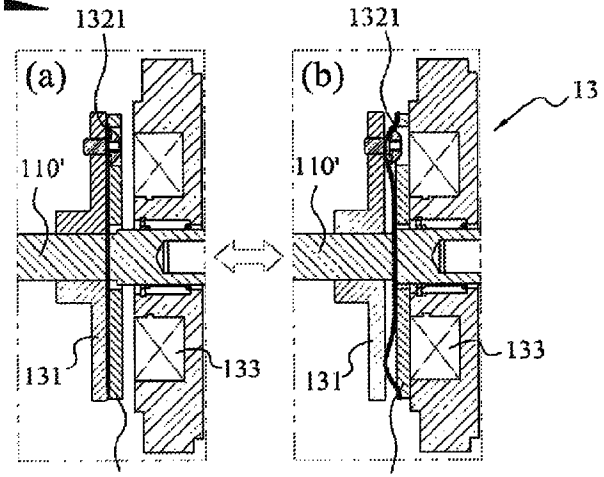

The brake mechanism 13 comprises: a braking disc 131 fixedly connected with the intermediate rotary shaft 110'; a braked disc 132, the right end face of which is coaxially connected with the opposite end face of the braking disc 131 through a spring strip 1321, and the braked disc 132 can axially displaced; and an electromagnetic disc 133 made by, for example, conventional electromagnet which is firmly fixed on the housing of the electric machine mechanism 1. The braking disc 131 is separated from the braked disc 132 by a gap. When the electromagnet is excited by electronic power, the braking disc 131 attracts the braked disc 132 together so as to hold the intermediate shaft 110' to be stationary, as shown in FIG. 1, and (b) of FIG. 1*d*.

The centrifugal brake mechanism 14 is a conventional centrifugal brake unit and is located at the left side of the electromagnetic disc 133 and is coaxially fixed on the left end face of the braking disc 131. The function of the centrifugal brake mechanism 14 is to automatically limit the rotational speed of the intermediate shaft 110' by centrifugal action, when rotational speed of the intermediate shaft 110' is beyond a predetermined safety limit. The reduction mechanism 15 includes a reduction gear unit 150 of a train of gears. The input end of the reduction gear unit 150 is connected to the second end of the intermediate rotary shaft 110', while the output end is an output shaft 160.

Figure 1E:
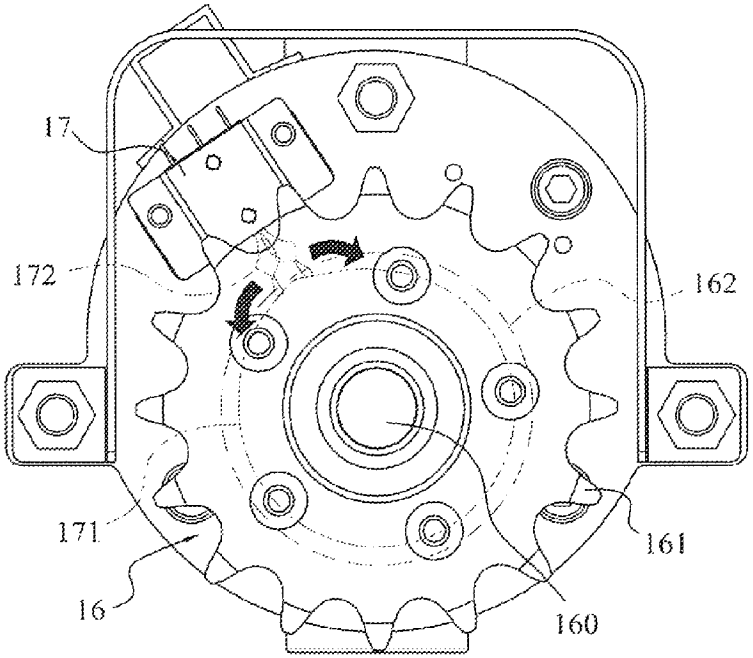
Figure 1F:
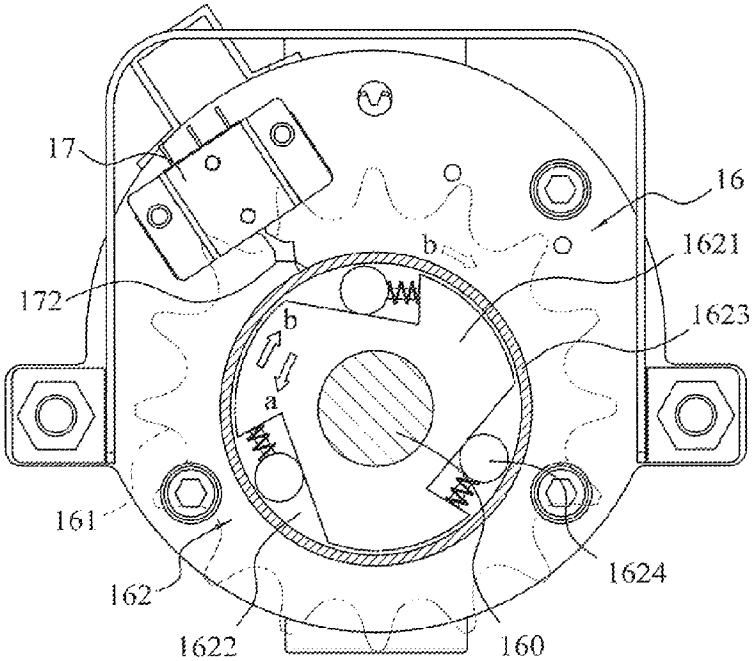
Figure 1G:
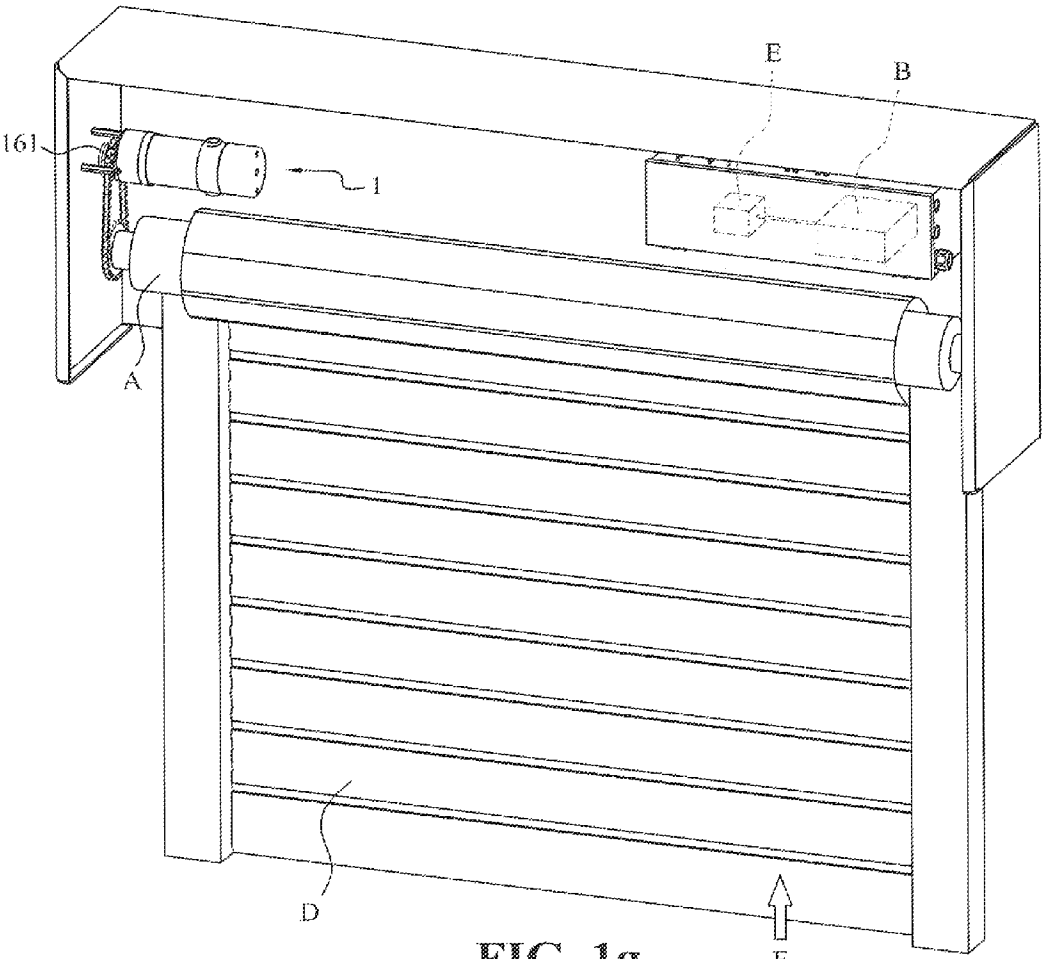

The output mechanism 16 includes an output pulley 161 and an one-way transmission device 162, in which the one-way transmission device 162 is driven by the output shaft 160 with the output pulley 161 rotated under control. In more detail, the one-way transmission device 162 is provided between the other end of the output shaft 160 and the output pulley 161. When power is inputted from the output shaft 160, it is outputted from the output pulley 161. The output pulley 161 rotates an winding shaft A for door slats, as shown in FIG. 1*g*.

The one-way transmission device 162 is conventional. As shown in FIGS. 1*e* and 1*f*, the one-way transmission device 162 comprises: an active member 1621 fixed on the output shaft 160, the active member 1621 having a plurality of toothed grooves 1622 opening in a predetermined direction; a passive member 1623 having a ring section fitted on the outside of the active member 1621, the passive member 1623 being fixedly connected with the output pulley 161; and a plurality of limiting members 1624, each of which is biased by an elastic element and is received in a corresponding toothed grooves 1622, for limiting the passive member to follow the active member 1621 in the predetermined direction. When the output shaft 160 is rotated in a free-rotational direction, for example, a, the output shaft 160 is rotated freely relative to the output pulley 161; when the output shaft 160 is rotated in a predetermined rotational direction b, the output shaft 160 drives the output pulley 161 to rotate therewith; alternatively, when the output pulley 161 is rotated in predetermined rotational direction b, the output pulley 161 is rotated freely relative to the output shaft 160.

Referring to FIGS. 1*e* and 1*f*, the output mechanism 16 further comprises a rotational direction detecting module 17 for detecting a direction of rotation of the output pulley 161. The rotational direction detecting module 17 is provided on a predetermined point at the outside of the one-way transmission device 162. The rotational direction detecting module 17 includes a detected disc 171 and a direction detector 172. The detected disc 171 is fixedly connected to the passive member 1623 and linked up with the output pulley 161 to rotate together, while the direction detector 172, which is a contact type or non-contact type, is located at one side of the detected disc 171. The direction detector 172 is to detect the rotation of the detected disc 171, i.e., to determine a direction of rotation of the output pulley 161.

Basically, the control circuit E is electrically connected with the electric machine mechanism 11, the brake mechanism 13, the rotational direction detecting module 17 and other fire detection devices such as smoke detector, temperature sensor, and fusible link device. The control circuit E further comprises a battery module B which is used to store electricity in normal time so as to provide spare power in case that there is an electrical power interruption.

In this way, the control circuit E ordinarily controls the electric machine mechanism 11 so as to control the output shaft 160 to rotate in the predetermined rotational direction b, and then the output pulley 161 drives the winding shaft A to wind up slats D of the rolling door to lift. When the electric machine mechanism 11 stops to rotate, the electromagnetic disc 133 of the brake mechanism 13 is excited to brake the rotary shaft 110 to be stationary. Alternatively, if a electrical power interruption is confirmed by a fire detection device, such as smoke detector, temperature sensor, fusible link device, the power source is cut off and the electromagnetic disc 133 stops the excitation to release the braking disc 131 and the slats D of the rolling door roll downward by their own weight to block raging flame or thick smoke from scattering outward. Alternatively, if the rolling door has to be reopened for fire escape in case of an emergency condition, then an external force F is applied on the door slats D to push the door slats D upward. As such, the direction detector 172 of the rotational direction detecting module 17 detects the slight upward displacement of the door slats D, and then the control circuit E activates to supply power to the electric machine mechanism 11 from the battery module B to assist the driving of the winding shaft A to wind up the door slats D. Therefore, the purpose of labor saving and quick opening of rolling door can be achieved. The rolling door is restored to shut-down state again after it is maintained opening for a predetermined time.

Figure 2:
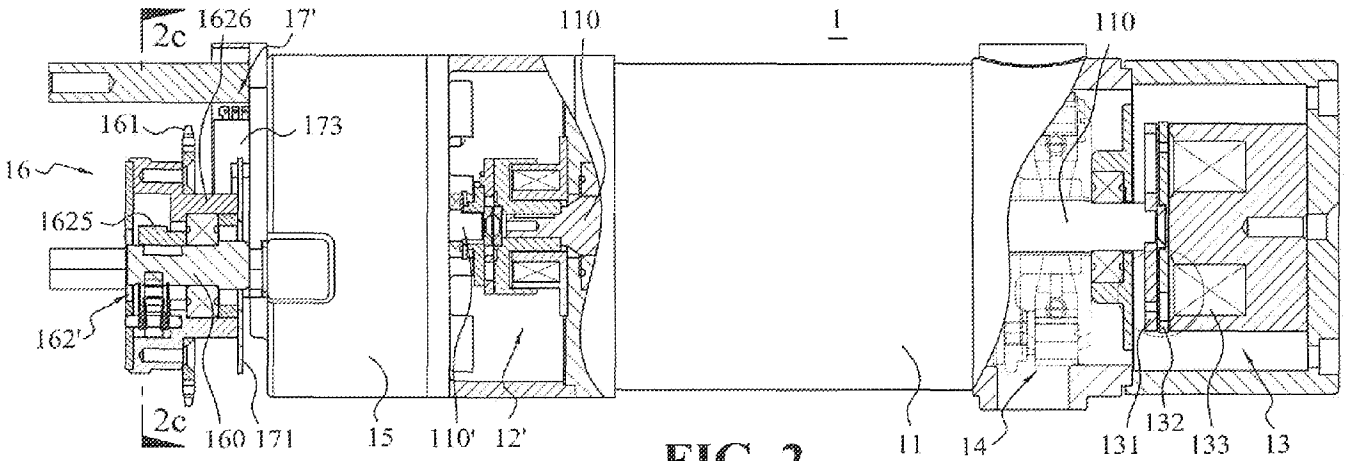
Figure 2A:
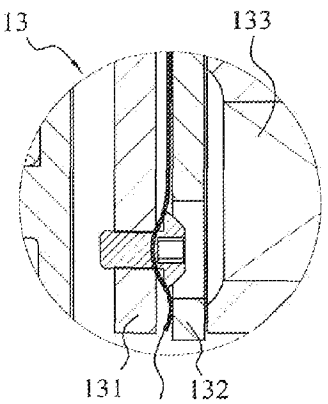

The second embodiment of the door machine mechanism 1 of the present invention will be described by referring to FIGS. 2, 2*a*~2*c*. Basically, the second embodiment shown in FIG. 2 is the same as the first embodiment, therefore detailed description is omitted. The difference lies in that an electromagnetic clutch mechanism 12' is used in the second embodiment to substitute the centrifugal clutch mechanism 12, and a ratchet device is used in the second embodiment to substitute the one-way bearing.

Figure 2B:
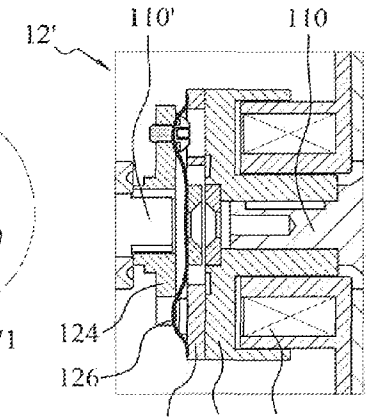

As shown in the figures, the clutch mechanism 12' comprises: a first member 123 fixed on the rotary shaft 110, the first member 123 having a coil winding 123*a*; a second member 124 connected to one end of the intermediate rotary shaft 110'; a clutch member 125 one end face of which is connected in an axially displaceable manner to the second member 124 through a spring strip 126, and the other end face of which is separated from the first member 123 by a gap; when the coil winding 123*a* is excited, the first member 123 attracts the clutch member 125 so that the rotary shaft 110 and the intermediate rotary shaft 110' simultaneously couples with each other to rotate, as shown in FIG. 2*b*. Under non-excited state of the coil winding 123*a*, the clutch member 125 is separated from the first member 123 so that the intermediate rotary shaft 110' is decoupled with the rotary shaft 110 and the door slabs D, in power interruption state due to fire, can move down smoothly to shut the door.

Figure 2C:
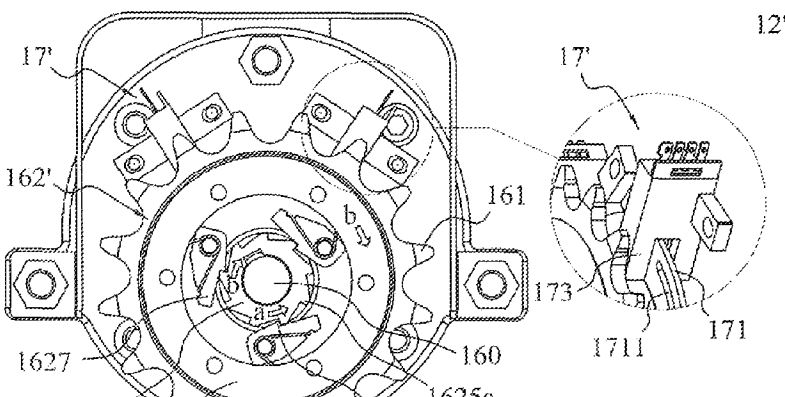

As shown in FIG. 2*c*, the one-way transmission device 162' comprises an active gear 1625, a bushing 1626, and a plurality of clutch members 1627. The active gear 1625 is fixed on the output shaft 160 and has a plurality of ratchets 1625*a* heading in a preset direction; the bushing 1626 is fitted on the outside of the active gear 1625 and is fixedly connected to the output pulley 161. The plurality of clutch members 1627 is respectively located at a plurality of points on the outer circumference of the active gear 1625. One end of each clutch member 1627 is pivotally connected on the bushing 1626 so as to allow each clutch member to swing, the other end of each clutch member 1627 has a pawl 1627*a* that store potential energy of elastic element to engage on the ratchet 1625*a* of the active gear 1625, so as to limit the bushing 1626 to follow the active gear 1625 in a preset rotational direction. When the bushing 1626 is rotated in the preset rotational direction b, the bushing 1626 is rotated freely relative to the active gear 1625.

Further, a rotational direction detecting module 17' comprises the detected disc 171 and a pair of photosensors 173. The detected disc 171 has a plurality of opened slots 1711. The detected disc 171 is fixedly connected with the bushing 1626 of an one-way transmission device 162' and links up with the output pulley 161. The pair of photosensors 173 is disposed at one side of the detected disc 171 and is electrically connected to the control circuit E. If a rotation of the detected disc 171 is detected through the opened slots 1711 of the detected disc 171 by the photosensors 173, this means a rotational direction of the output pulley 161 can be determined. In case the rolling door should be reopened for fire escape in emergency condition, an external force F is applied on the door slats D to push the door slat D upward. As such, if the photosensors 173 detects the rotation of the output pulley 161, then the control circuit E is activated to supply electricity to the electric machine mechanism 11 from the battery module B so as to assist the driving of the winding shaft A to wind up the door slats D to open. The rolling door will recover to its shut-down state after the rolling door opening for a predetermined time, and hence avoids the scattering of fire flame and smoke.

Figure 3:
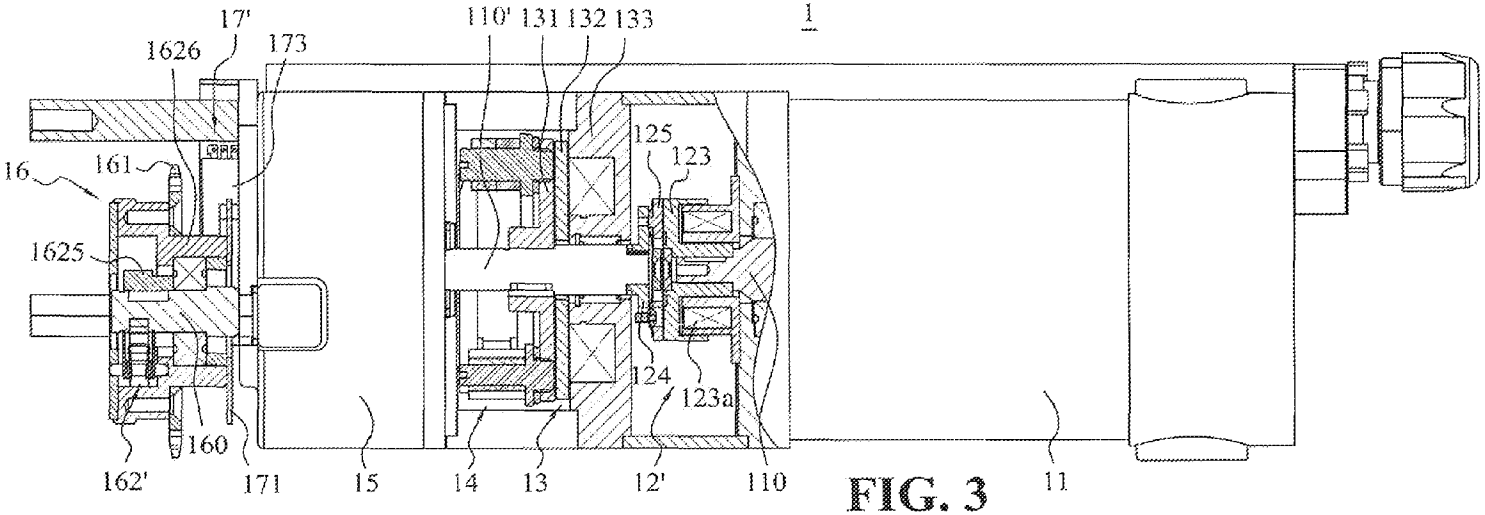
FIG. 3 is a partially exploded perspective view showing the third embodiment of door machine mechanism of the present invention.

The third embodiment of the door machine mechanism 1 having fireproof, smokeproof and escape functions for rolling door of the present invention will be described by referring to FIG. 3. The difference of the third embodiment with the second embodiment lies in that the brake mechanism 13 and the centrifugal brake mechanism 14 is formed into a module structure, which is provided at the output end of the electric machine mechanism 11 and located between the clutch mechanism 12' and the reduction mechanism 15. Not only the same equivalent effect as aforementioned embodiments can be achieved, but also the modular structure can be taken by apart easily for maintenance.

Figure 4:
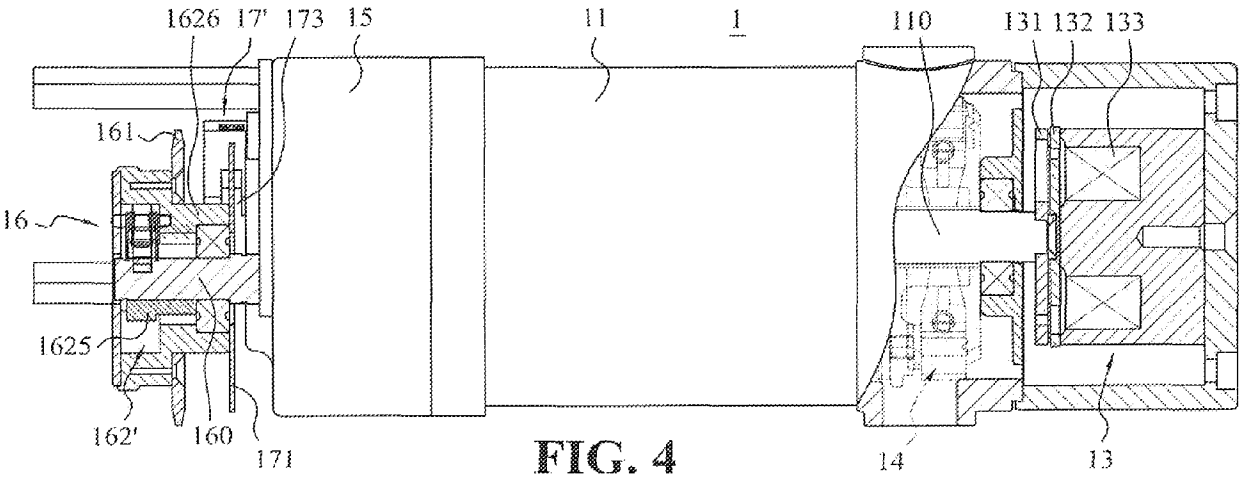
FIG. 4 is a partially exploded perspective view showing the fourth embodiment of door machine mechanism of the present invention

The fourth embodiment of the door machine mechanism 1 having fireproof, smokeproof and escape functions for rolling door of the present invention is shown in FIG. 4. The difference of this embodiment with the first, the second and the third embodiments lies in that there is no clutch mechanisms 12, 12'. When the electric machine mechanism 11 stops to rotate, the rotary shaft 110 is subject to an action of a counter electromotive force which acts as a resistance to the rolling-down of door slats. However, it is apparent to those who have ordinary knowledge in the art, the counter electromotive force can be offset by changing the ratio between the weight of the door slats and the preload on the spring of the winding shaft. In this manner, the door slats D in power interruption state due to fire can move down smoothly to shut the door.

While the preferred embodiments have been described as above, it is noted that the description and accompanying drawings disclosed herein are not intend to restrict the scope of implementation of the present invention. Modifications and variations proposed without departing from the scope of the claims of the present invention are considered to be still within the scope of the present invention.

What is claimed is:

1. A door machine mechanism (1) for a rolling door, comprising:

an electric machine mechanism (11) comprising a rotary shaft (110) for outputting power;

a clutch mechanism (12) comprising a first clutch member (121) coaxially connected to said rotary shaft (110), and a second clutch member (122) connected to one end of an intermediate rotary shaft (110'), when said rotary shaft (110) is actuated to rotate with said first clutch member (121), said first clutch member (121) urges against said second clutch member (122) to rotate along therewith by centrifugal force;

a brake mechanism (13) comprising a braking disc (131) fixedly connected with said intermediate rotary shaft (110'); a braked disc (132) coaxially mounted on said intermediate rotary shaft (110') with said braking disc (131); and an electromagnetic disc (133) disposed on a periphery of said intermediate rotary shaft (110') and connected to a housing of said electric machine mechanism (11); wherein said braked disc (132) is axially displaceable and spaced from said braking disc (131) by a spring piece (1321), and said electromagnetic disc (133) is spaced from said braked disc (132) by a gap;

an output mechanism (16) comprising an output shaft (160), an output pulley (161) and an one-way transmission device (162), one end of said output shaft (160) being coupled to the other end of said intermediate rotary shaft (110'), said one-way transmission device (162) comprising an active member (1621) disposed on said output shaft (160) and having a plurality of wedge-shaped toothed grooves (1622) at a circumference thereof; a passive member (1623) comprising an out ring disposed on an outer periphery of said active member (1621) and configured to define a plurality of cavities between said passive member (1623) and said plurality of wedge-shaped toothed grooves (1622); and a plurality of wedging members (1624), each being received in one of said plurality of cavities; wherein said output pulley (161) being fixedly connected with said passive member (1623) and coupled to a winding shaft (A) for door slats (D), when said output pulley (161) rotates along with said passive member (1623) in a first predetermined direction (a), said output pulley (161) and said passive member (1623) being capable of rotating freely relative to said output shaft (160), and when said output shaft (160) rotates in a second predetermined direction (b), said plurality of wedging members (1624) are secured between said active member (1621) and said passive member (1623) and provide a wedging action, thereby urging said passive member (1623) to rotate with said output pulley (161); and a control circuit (E) electrically controlling with said electric machine mechanism (11) to actuate said rotary shaft (110) to drive said output shaft (160) so as to activate said winding shaft (A) to roll up or roll down the door slats (D), and when said electric machine mechanism (11) is deactivated, said electromagnetic disc (133) is excited to engage said braked disc (132), thereby forcing said braking disc (131) to brake said rotary shaft (110), wherein in the event of a power failure, said electromagnetic disc (133) disengages said braked disc (132), and said door slats (D) drop by gravity; when an upward lifting force (F) is applied on said door slats (D), said output pulley (161) is actuated to rotate in said second predetermined direction (b), thereby activating said winding shaft (A) to roll up said door slats (D).

2. The door machine mechanism (1) as claimed in claim 1, wherein said one-way transmission device (162') comprises an active gear (1625), a bushing (1626) and a plurality of clutch members (1627), said active gear (1625), which has a plurality of ratchets (1625*a*) and which is fixed on said output shaft (160), said bushing (1626) being fitted on said active gear (1625) and being fixedly connected with said output pulley (161), said plurality of clutch members (1627) being located between said active gear (1625) and said bushing (1626), each of said clutch members (1627) having one end pivotally connected on said bushing (1626) and the other end having a pawl (1627*a*) for engagement with said ratchet (1625*a*) of said active gear (1625), so that when said bushing (1626) is rotated in said preset rotational direction (b), said bushing (1626) being rotated freely relative to said active gear (1625), and when said output shaft (160) is rotated in said preset rotational direction (b), said pawls (1627*a*) of said plurality of clutch members (1627) are engaged with said active gear (1625) in order to link up said active gear (1625) and said bushing (1626) together.

3. The door machine mechanism (1) as claimed in claim 1, wherein said electric machine mechanism (11) comprises a DC motor.

4. The door machine mechanism (1) as claimed in claim 1, wherein said electric machine mechanism (11) comprises a DC motor the rotary shaft (110) of which is coupled to said output shaft (160) through an intermediate rotary shaft (110'); a clutch mechanism (12') including a first member (123), a clutch member (125) and a second member (122), said first member (123) being fixedly connected on said rotary shaft (110), said first member (123) having a coil winding (123*a*), said second member (124) being connected to one end of said intermediate rotary shaft (110'); a spring plate (126) provided between one end face of said clutch member (125) and an opposite end face of said second member (124), the other end face of said clutch member (125) being separated from said first member (123) by a gap; wherein in an excited state of said coil winding (123*a*), said first member (123) attracts said clutch member (125) to connect together so as to couple said rotary shaft (110) and said intermediate rotary shaft (110') together.

5. The door machine mechanism (1) as claimed in claim 1, further comprising a reduction mechanism (15) which couples said rotary shaft (110) of said electric machine mechanism (11) to said output shaft (160) of said output mechanism (16).

6. The door machine mechanism (1) as claimed in claim 1, further comprising a centrifugal brake mechanism (14) disposed on the periphery of said rotary shaft (110) of said electric machine mechanism (11), wherein said centrifugal brake mechanism (14) is capable of reducing a rotational speed of said rotary shaft (110) when said rotational speed of said rotary shaft (110) exceeds a predetermined value.

7. The door machine mechanism (1) as claimed in claim 1, wherein said output mechanism (16) further comprises a rotational direction detecting module (17) electrically connected to said control circuit, for detecting said second predetermined direction (b).

8. The door machine mechanism (1) as claimed in claim 7, wherein said rotational direction detecting module (17) comprises a detected disc (171) fixedly connected to said passive member (1623), and at least one direction detector (172) disposed at one side of said detected disc (171), said at least one direction detector (172) being electrically connected to said control circuit (E) so as to detect the change of the direction of rotation of said detected disc (171).

9. The door machine mechanism (1) as claimed in claim 8, wherein said at least one direction detector (172) comprises at least one photosensor (173) electrically connected to said control circuit (E) so as to detect the direction of rotation of said detected disc (171).

10. The door machine mechanism (1) as claimed in claim 7, further comprising a battery module (B) providing for a reserve power in the event of a power failure, so that at the time when said upward lifting force is applied on said door slats, and renders said door slats to be capable of being raised a certain extent, and when said rotational direction detecting module (17) detects the rotation movement of said output pulley (161) in said second predetermined direction (b), which signals said control circuit (E) to activate said electric machine mechanism (11) to drive said output shaft (160) to rotate in said second predetermined direction (b), so as to activate said winding shaft (A) to roll up said door slats (D), thereby assisting the opening of the rolling door.

11. A door machine mechanism for a rolling door, comprising:

an electric machine mechanism to produce power, including a rotary shaft and an intermediate rotary shaft coupled to the rotary shaft;

a clutch mechanism comprising a first clutch member coaxially connected to said rotary shaft; and a second clutch member connected to one end of an intermediate rotary shaft so that, when said rotary shaft is actuated to rotate with said first clutch member, said first clutch member urges against said second clutch member to rotate along therewith, via centrifugal force;

a brake mechanism comprising a braking disc secured to said intermediate rotary shaft, a braked disc coaxially mounted on said intermediate rotary shaft with said braking disc and axially displaceable from said braking disc by a spring piece, and an electromagnetic disc disposed on a periphery of said intermediate rotary shaft and spaced from said braked disc by a gap;

an output mechanism comprising an output shaft having one end coupled to the other end of said intermediate rotary shaft, an output pulley, and an one-way transmission device to provide the rolling door with emergency escape function, wherein the one-way transmission device comprises an active member disposed on said output shaft and having a plurality of wedge-shaped toothed grooves at a circumference thereof, a passive member comprising a ring disposed on an outer periphery of said active member and configured to define a plurality of cavities between said passive member and said plurality of wedge-shaped toothed grooves, and a plurality of wedging members each of which is received in one of said plurality of cavities;

wherein said output pulley is connected to said passive member and coupled to a winding shaft for door slats, and when said output pulley rotates along with said passive member in a first predetermined direction, said output pulley and said passive member rotate relative to said output shaft, and when said output shaft rotates in a second predetermined direction, said plurality of wedging members are secured between said active member and said passive member and provide a wedging action, thereby urging said passive member to rotate with said output pulley; and a control circuit arranged to control said electric machine mechanism to actuate said rotary shaft to drive said output shaft so as to activate said winding shaft to roll up or roll down the door slats, and when said electric machine mechanism is deactivated, said electromagnetic disc is excited to engage said braked disc, thereby forcing said braking disc to brake said rotary shaft, wherein in the event of a power failure, said electromagnetic disc disengages said braked disc and said door slats roll down by gravity; and when an upward lifting force is applied on said door slats, said output pulley is actuated to rotate in said second predetermined direction, thereby activating said winding shaft to roll up said door slats.

12. The door machine mechanism as claimed in claim 11, wherein said electric machine mechanism comprises a DC motor.

13. The door machine mechanism as claimed in claim 11, further comprising a reduction mechanism which couples said rotary shaft of said electric machine mechanism to said output shaft of said output mechanism.

14. The door machine mechanism as claimed in claim 11, further comprising a centrifugal brake mechanism disposed on the periphery of said rotary shaft of said electric machine mechanism, and operable to reduce a rotational speed of said rotary shaft when said rotational speed of said rotary shaft exceeds a predetermined value.

15. The door machine mechanism as claimed in claim 1, wherein said output mechanism further comprises a rotational direction detecting module electrically connected to said control circuit, to detect the rotation in said second predetermined direction.

16. The door machine mechanism as claimed in claim 7, wherein said rotational direction detecting module comprises a detected disc fixedly connected to said passive member, and at least one direction detector disposed at one side of said detected disc, wherein said at least one direction detector is electrically connected to said control circuit so as to detect the change of the direction of rotation of said detected disc.

17. The door machine mechanism as claimed in claim 11, further comprising a battery module to provide reserve power in the event of a power failure, so that at the time when said upward lifting force is applied on said door slats, said door slats are raised to a certain extent, and when said rotational direction detecting module detects the rotation movement of said output pulley in said second predetermined direction, said control circuit activates said electric machine mechanism to drive said output shaft to rotate in said second predetermined direction, so as to activate said winding shaft to roll up said door slats, thereby assisting the opening of the rolling door.

* * * * *